United States Patent [19]

Papanicolaou

[11] Patent Number: 4,565,165

[45] Date of Patent: Jan. 21, 1986

[54] INTERNAL COMBUSTION ENGINE

[76] Inventor: John P. S. Papanicolaou, Nissos Agia Trias, Eretria, Chalkidos, Greece

[21] Appl. No.: 633,199

[22] Filed: Jul. 23, 1984

[30] Foreign Application Priority Data

Feb. 17, 1984 [GB] United Kingdom ..... 8404159

[51] Int. Cl.[4] ..... F02B 75/26

[52] U.S. Cl. ..... 123/51 BA; 123/58 AM

[58] Field of Search ..... 123/58 R, 58 A, 58 AA, 123/58 AM, 51 R, 51 B, 51 BA

[56] References Cited

U.S. PATENT DOCUMENTS

| | | | |
|---|---|---|---|
| 1,374,915 | 4/1921 | Fasey | 123/51 B |
| 1,389,873 | 9/1921 | Hult | 123/51 AA |
| 1,788,140 | 1/1931 | Woolson | 123/51 AA |
| 1,808,083 | 6/1931 | Tibbetts | 123/51 AA |
| 1,972,335 | 9/1934 | Gardner | 123/51 BA |
| 2,080,846 | 5/1937 | Alfaro | 123/58 AM |
| 2,118,804 | 5/1938 | Andersen | 123/78 F |
| 2,366,595 | 1/1945 | Christopher | 123/58 AM |
| 3,598,094 | 10/1971 | Odawara | 123/58 R |
| 4,023,542 | 5/1977 | Ango | 123/58 R |

FOREIGN PATENT DOCUMENTS

| | | |
|---|---|---|
| 380650 | 9/1932 | United Kingdom . |
| 2050509 | 1/1981 | United Kingdom . |

OTHER PUBLICATIONS

Rodney M. Herbert et al., Improved Engine Efficiency with Emphasis on Expansion Ratios, Oct. 1979, 1st Intn'l Automotive Fuel Economy Research Conference.

*Primary Examiner*—Craig R. Feinberg

*Attorney, Agent, or Firm*—Lerner, David, Littenberg, Krumholz & Mentlik

[57] ABSTRACT

A hyper-expansion internal combustion engine operable using a cycle having expansion, exhaust, intake and compression phases comprising at least one pair of opposed pistons which reciprocate in cylinder portions which are in fluid communication with each other via a common combustion chamber, the pistons being coupled to respective cam elements engaged with a common output shaft for converting the reciprocating motion of the pistons into rotational motion, the cylinder portions having intake and exhaust ports in the cylinder walls arranged such that each intake port is engaged by one piston and each exhaust port is engaged by the respective opposed piston; and the cam elements are provided with different cam profiles which are arranged to cause the respective pistons to uncover the respective exhaust and inlet ports so as to produce a sufficient increase in the effective volume of the expansion phase with respect to the intake phase to give hyper-expansion.

30 Claims, 12 Drawing Figures

INTERNAL COMBUSTION ENGINE

This invention relates to an internal combustion engine operable using a cycle having expansion, exhaust, intake and compression phases, comprising at least one pair of opposed pistons which reciprocate in respective cylinder portions which are in fluid communication with each other via a common combustion chamber, the pistons being coupled to respective cam elements engaged with a common output shaft for converting the reciprocating motion of the pistons into rotational motion and the cylinder portions having intake and exhaust ports in the cylinder walls arranged such that each intake port is engaged by one piston and each exhaust port is engaged by the respective opposed piston.

Internal combustion engines operable using a cycle having expansion, exhaust, intake and compression phases, where the reciprocating motion of the engine pistons is converted into rotational motion of an output shaft via a crankshaft are well known. Such engines conventionally use either four or two stroke cycles. In a four stroke cycle engine, the engine cycle is effected within four strokes of a working piston. In a two stroke cycle engine, all four phases of the cycle are effected within two strokes of a working piston.

Two and four stroke engines each have their own advantages and disadvantages.

Four stroke engines generally have better scavenging than their two stroke counterparts but suffer from the need for complicated valve mechanisms to regulate exhaust and intake charge flow. Two stroke engines, on the other hand, have a simple arrangement of ports for the transfer of charge and exhaust gases from the cylinder, the opening and closing of the ports being controlled by the working piston. They also develop power on each rotation of the crankshaft, in contrast to four stroke engines which generate power every other rotation of the crankshaft. Accordingly, they have an improved power/weight ratio. However, two stroke engines have poor scavenging characteristics and fuel efficiency, as well as a tendency to generate combustion gases with a high pollution content. These disadvantages have tended to outweigh their constructional and power to weight advantages for many applications, and they are subject to legal restrictions.

It was recognized in the 1920's that use of a cam or swash plate instead of a crankshaft permitted greater flexibility in engine contruction. For example stroke length and reciprocation speed could be varied by changing the cam profile; it was possible to arrange multiple cylinders around a common shaft as well as to position them in a horizontally opposed construction. The Michell engine of U.S. Pat. No. 1,404,057 was constructed in 1923. Proposals were mainly confined to four cycle engines, for example as disclosed in Michell (above), U.S. Pat. No. 1,389,873 (Hult), and later in U.S. Pat. No. 3,598,094 (Odawara) and GB No. 2,050,509A (Kristiansen). Also more complicated cycle engines were attempted for example as proposed in U.S. Pat. No. 1,788,140 and U.S. Pat. No. 1,808,083.

In 1885, Atkinson proposed a cycle, which contrasted with the Otto and Diesel cycles in that the combustion gases were more fully expanded, idealy to ambient pressure, to obtain greater combustion efficiency, a possibility not open to engines in which the power and intake strokes and volumes were identical, a constraint imposed by the simple piston/crankshaft combination.

It was recognised by Hult in 1921 that by choosing an irregular cam plate profile it was possible to make the expansion and intake strokes, of a four stroke engine, of significantly different lengths, thus giving greater expansion efficiency for the engine along the line proposed by Atkinson. However, these engines were of highly complicated construction and any advantages gained by the greater expansion efficiency tended to be off-set by other losses. No commercially successful models are known to have been made.

Engines deliberately designed to benefit from a higher combustion efficiency by using an expansion volume greater than the intake volume came to be known as "hyper-expansion engines" (H. H. Kristiansen "Improved Engine Efficiency with Emphasis on Expansion Ratios"—see below).

A recent four-cycle hyper-expansion engine still under development is the Kristiansen engine (GB Nos. 1,467,969, 2,050,509). This uses a rotating cylinder block with circumferentially arranged ports, operated through a swash plate. Such an engine is inherently limited in R.P.M.

It was also recognised in the 1920's (for example in U.S. Pat. No. 1,374,915 (Fasey) and GB No. 380,650 (Kreidler)) that the scavenging efficiency of two stroke engines could be improved by the use of a cam or swash plate, by adjusting the cam profile to set the port opening and closing positions. To obtain better scavenging, Kreidler arranged to close the intake port in two stages which the exhaust port was closing gradually, through a slight differentiation of the cam profiles. The expansion and intake volumes remained substantially the same.

A similar two-cycle engine using a cam plate was later proposed by Alfaro, in UK Pat. No. 421,126 (and a test model later produced) in which identical cam plates were used in opposed formation in a common cylinder, the exhaust and intake ports of the engine being controlled by the respective opposed pistons. The design was proposed for aircraft use, power being taken from a central shaft around which the cylinders were disposed.

These engines, however, still suffered from the disadvantages associated with two-cycle engines and, like all swash or cam plate engines, were not a commercial success.

It is an aim of the present invention to provide an internal combustion engine which enables the benefits of high power/weight ratio and optimum combustion efficiency and fuel economy to be combined and achieved within a practical embodiment.

In one aspect, the invention is characterised by the cam elements being provided with different cam profiles which are arranged to cause the respective pistons to uncover the respective exhaust and inlet ports so as to produce a sufficient increase in the effective volume of the expansion phase with respect to the intake phase to obtain hyper-expansion.

In a second aspect the invention is characterised by the cam elements being provided with cam profiles which are asymmetric over a cam circumferential portion additional to that required for port opening or closing whereby the ratio of expansion ratio to compression ratio is at a value greater than 1 and not exceeding 2.

In a third aspect of the invention a two cycle internal combustion engine is provided in which the intake gases are input to a cylinder volume less than the cylinder volume to which the combusted gases are expanded by an amount sufficient to obtain hyper-expansion.

In another aspect of the invention an internal combustion engine is provided in which at least one of the cam elements has an adjustable cam profile.

In a preferred aspect of the invention cam element profiles are arranged so that the exhaust and intake phases overlap to define an idle phase in which both exhaust and intake ports are open, and improve scavenging.

Embodiments of the invention will now be described, by way of example, with reference to the accompanying, generally diagrammatic, drawings, in which.

Figure 1:
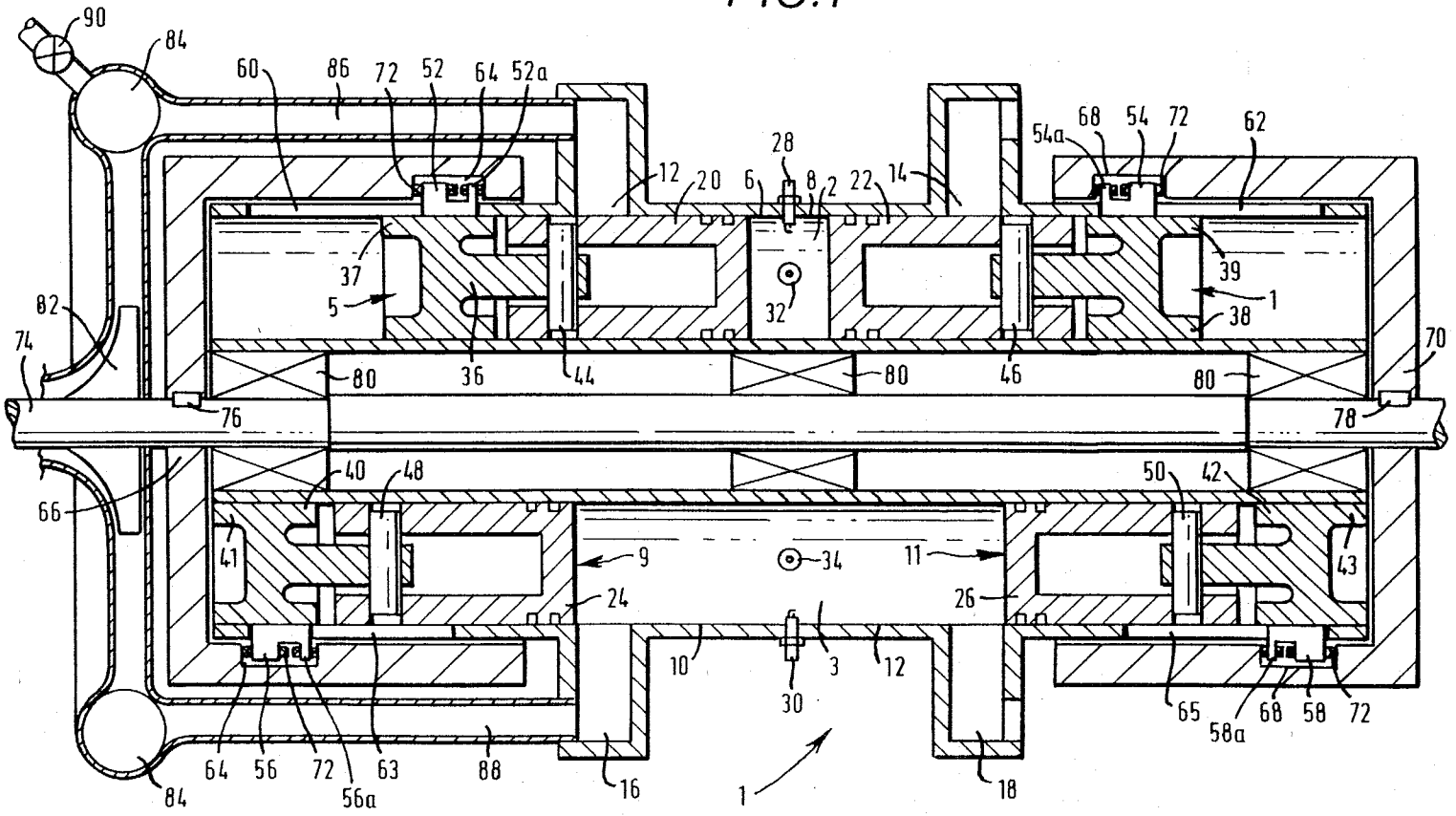
FIG. 1 is a longitudinal cross-sectional view of an embodiment of the invention.

Referring to FIG. 1, an embodiment of the internal combustion engine of the invention is shown.

The engine 1 has two cylinders 2,3, notionally divided into cylinder portions 6, 8, 10, 12 in which respective opposed piston assemblies 5, 7; 9, 11 reciprocate.

The cylinder 2 has intake and exhaust ports 12, 14 provided in the walls of portions 6,8, so that flow through the ports 12,14 is controlled by respective pistons 20,22 of the piston assemblies 5,7.

Similarly, cylinder 3 has intake and exhaust ports 16,18 provided in the walls of portions 10,12, so that flow through the ports 16,18 is controlled by respective pistons 24,26 of the piston assemblies 9,11.

Each cylinder 2,3 is further provided with spark ignition means 28,30 and fuel injection means 32,34 at the centre position of each cylinder 2,3. This centre position forms a common combustion chamber. If desired, the engine 1 may include carburation means, instead of the fuel injection means 32,34.

Each piston 20,22; 24,26 is rigidly secured to a respective connecting rod 36,38; 40,42 by means of a splined pin 44,46; 48,50 which prevents relative movement in any plane, so that the connecting rods 36,38; 40,42 are constrained to slide in the cylinders 2,3 following the motion of the pistons 20,22; 24,26. The connecting rods are provided with cylindrical portions 37,39,41,43 which engage the inner surface of the cylinders 2,3, which are lubricated to reduce frictional losses.

The pistons 20,22; 24,26 and connecting rods 36,38; 40,42 may, alternatively, be formed as a single casting if desired, dispensing with the need for the pins 44,46; 48,50.

Each connecting rod 36,38; 40,42 has a pair of cam-groove engaging pins **52,52*a*, 54,54*a*, 56,56*a*, 58 and 58*a* attached thereto, which project through a respective elongate slot 60,62; 63,65 in the walls of cylinder 2,3. In this way, the pistons engage the cylinder walls as far as bottom dead centre, effectively containing side loads imposed on the piston assemblies generated by the cam profiles. Slots 60,62,63,65** are positioned so that the cylinder liners in which they are formed are not weakened in the direction in which the side loads act.

Figure 2:
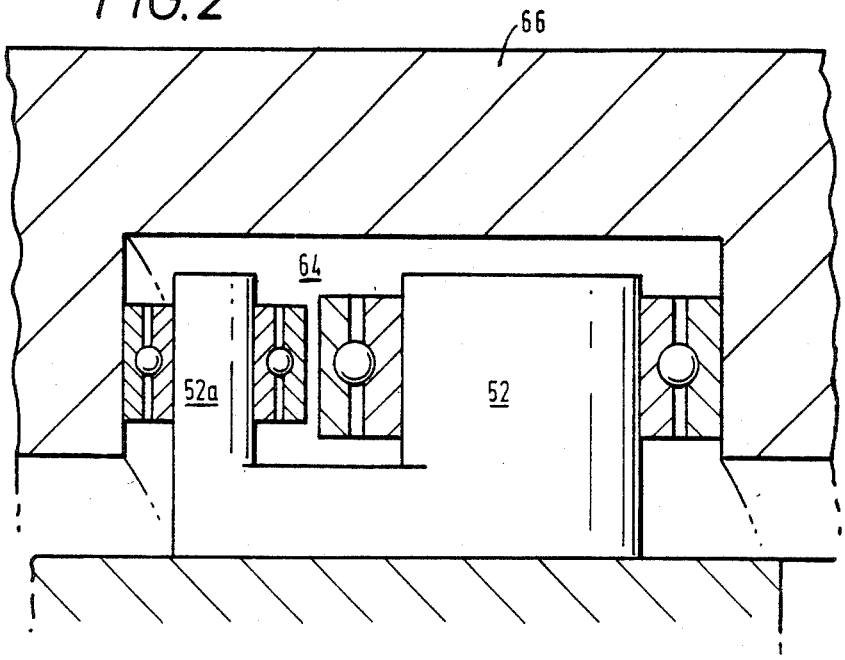
FIG. 2 shows detail of a bearing arrangement of the FIG. 1 embodiment.

Pins **52,52*a* and 56,56*a* engage in a circumferential groove 64 formed in a circular cam element 66. Pins 54,54*a* and 58,58*a* engage in a circumferential groove 68 formed in a circular cam element 70. The pins 52,52*a*, 54,54*a*, 56,56*a* 58,58*a* are mounted relatively to the grooves 64,68 by means of respective ball bearing, or roller races, 74',76' as shown in detail in FIG. 2 in which pins 52,52*a* are shown, (the other bearing arrangements being of similar form). Pin 52*a* engages the inner lip of the groove 64 and acts as a follower. Pin 52 is of larger diameter than pin 52*a* and engages the outer lip of groove 64**, against which most of the load from the piston assembly is applied.

Cam elements 66,70 are rigidly fixed to an output shaft 74, by means of keys 76,78 for example. The output shaft runs along the central axis of the engine 1 and is supported relative to cylinders 2,3, by means of bearings **80*a,b,c*, of which the bearing 80*b* has a thrust bearing function and engages a reaction surface of shaft 74** to prevent axial movement.

If desired the cam elements 66,70 may be formed with axially circumferential peripheries which are similar to grooves 64, 68, to reduce weight. Furthermore it will be appreciated that, the width of the grooves 64,68, will change, according to the gradient of the groove, to accomodate the double pin arrangements (e.g. **52,52*a***).

Intake ports 12,16 are connected to a supercharger 82, attached to output shaft 74. The supercharger 82 has an annular plenum chamber 84, to which intake connecting pipes 86, 88 are attached. A pressure release valve 90 is provided to the chamber 84, for venting excess supercharger pressure. The valve may be controllable, so that its release pressure may be regulated in accordance with a throttle means, for example.

In practice, the supercharger may be replaced by other means of obtaining air under pressure, e.g. a positive displacement pump such as a Volumex pump, which may be e.g. belt driven through a gearbox.

Exhaust ports 14,18 lead to an exhaust pipe system (not shown).

In use, the piston assemblies 5,7; 9,11 reciprocate in the cylinders 2,3 and are constrained to follow the profile of the cam grooves 64,68. As the assemblies 5,7; 9,11 are also constrained to follow the line of the cylinders 2,3 containing them, the cam elements, and hence the output shaft, are forced to rotate as the piston assemblies reciprocate.

The cam elements 66,70 have different respective groove profiles, which cause the respective piston assemblies 5,7; 9,11 to reciprocate differently as will be hereinafter described.

Figure 3:
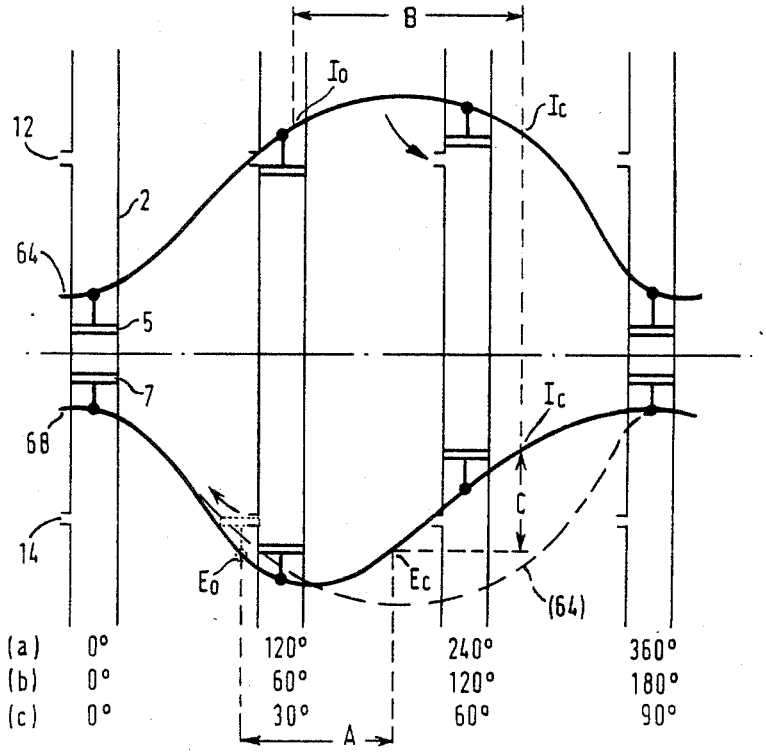
FIG. 3 is a diagram of a first engine cycle which can be attained using the invention.

Referring to FIG. 3, expanded profiles of the cam grooves 64,68 are shown. One pair of piston assemblies 5,7 are schematically represented within cylinder 2, at various stages of cam element rotation. Cam groove 64 is also shown as a broken line superimposed on cam groove 68, illustrating the different profiles. It can be seen that the asymmetricity extends over a substantial part of the cam circumference and e.g. much greater than that required for port opening and closing.

The cycle is shown between two compression phases. Any integral number of complete cycles may take place within a single rotation of the cam elements 66,70, a limiting factor being the gradient of the cam profiles. In FIG. 3(A) one cycle is shown for one revolution of the cam elements. In FIG. 3(B) one cycle is shown for half a revolution of the cam elements and in FIG. 3(c), one cycle is shown for a quarter of a revolution of the cam elements.

Starting with ignition at 0°, the piston assemblies 5,7 move outwardly to the position shown at e.g. 120° (FIG. 3A) in which the exhaust port 14 has opened (at Eo) while the intake port 12 is blocked by the piston assembly 5. At this stage the exhaust gases will blow down through exhaust port 14. The exhaust port 14 remains uncovered for period A.

Shortly after the exhaust port has been uncovered, piston assembly 5 moves outwardly still further to uncover the intake portion 12 (Io). (The intake port remains open for period B). Fresh charge, which is simply air in the case of the engine of the FIG. 1 embodiment, but may be air/fuel mixture if carburation is chosen in preference to fuel injection, is then forced in under pressure through the inlet port 12. In the FIG. 1 embodiment the inlet charge is forced in the cylinder 2 by means of supercharger 82. The inlet mixture then helps to displace the exhaust gases through port 14, for as long as the exhaust and inlet ports remain open together (i.e. the overlap of times A and B), thus replacing the exhaust gases with fresh charge.

The exhaust port 14 is closed by inward movement of the piston assembly 7 at point Ec. This inward movement continues into the next compression phase.

An intermediate situation is shown at e.g. 240° of cam element rotation. As can be seen, the upward movement of piston assembly 7, while the inlet port 12 is still open, pushes a proportion of the air induced into the cylinder out through port 12 towards the plenum chamber 84. Again, if carburation is being used, instead of fuel injection, the fuel stroke air mixture may be displaced into a fuel mixture reservoir (not shown) intermediate the carburettor and the intake port 12.

Thus, the cylinder volume between piston assemblies 5,7 to which the intake charge is input is less than that to which the combusted gases are expanded, by an amount corresponding to a cylinder length C.

The advantage, in terms of efficiency, which this gives can best be explained by considering the effect on the ratio of expansion ratio to compression ratio. The compression ratio of a conventional engine is defined as the ratio of the volume of working fluid within the cylinder at the beginning of compression, i.e. at closure of the intake port (FIG. 3) (hereinafter referred to as the intake volume) to the volume at full compression, i.e. the minimum cylinder volume attained (hereinafter referred to as the compression volume). The expansion ratio is defined as the ratio of the volume of the working fluid within the cylinder at the end of the cylinder restricted expansion, i.e. at opening of the exhaust port (FIG. 3) (hereinafter referred to as expansion volume) to the volume of the working fluid at the beginning of the expansion process. Assuming ignition takes place at full compression this will be the compression volume. Restriction of the intake volume with respect to the expansion volume, by reducing the effective intake stroke by the amount "C", results in a ratio of expansion ratio to compression ratio greater than 1, so that the combustion gases are now able to be expanded to a significantly greater volume than that to which they are input; this hyper-expansion process allows use to be made of expansion energy which is wastefully exhausted to atmosphere in engines with equal stroke length.

A fuller explanation of the theory of hyper-expansion is in a paper presented by H. H. Kristiansen to The First International Fuel Economy Research Conference, entitled "Improved Engine Efficiency with Emphasis on Expansion Ratios".

This reference gives graphs illustrating the theoretical increase in combustion efficiency resulting from different ratios of expansion ratio (ER) to compression ratio (CR) at different values of compression ratio.

Thus at a compression ratio of 8:1 there is a rise in efficiency from about 0.45 to about 0.53 at expansion ratio 1.5 and to about 0.57 at expansion ratio 2.0. At a compression ratio of 12:1 the corresponding efficiency increase is from about 0.51 to about 0.57 and 0.63 respectively.

The cylinder length C is preferably at least 10% of the distance between the exhaust port closure position of the piston and the centre of the common combustion chamber, and more preferably at least 25%. The distance C can be as much as essentially the whole of the distance from the exhaust port closure position to the centre of the common combustion chamber. In other words at closure of the intake port by the intake piston, the opposed piston is spaced from the corresponding exhaust port towards the centre of the common conbustion chamber by upto 100% of the total distance available, allowance being made for sufficient space for fuel injection and ignition means as well as the combustion space. Thus the ratio between expansion ratio and compression ratio can be as much as 2:1. Intermediate positions such as 50%, 60% or 70% of the available distance may be chosen depending upon the engine application and in particular its requirement for low throttle settings.

It is pointed out that the ratio between the compression pressure and the pressure at full expansion will not be dependent solely on the distance C and the cylinder geometry, but will also depend upon other factors such as the intake mixture pressure and strength. This again will be dependent upon the application of the engine.

After inlet port 12 has been closed (at Ic), both piston assemblies 5,7 proceed inwardly to a further compression stroke.

Thus, in this exemplary cycle, the advantages of providing different cam profiles can be seen. Firstly, the different cam profiles allow the ports to be opened and closed at different, precisely chosen times without requiring any complicated valve mechanisms, as the pistons provide a valve action. At the same time choice of cam profiles provides a significantly longer effective expansion phase than intake phase thus obtaining hyper expansion with attendant fuel economy and polution advantages over engines with equal stroke length.

In particular, it becomes possible to achieve the power/weight ratio of a two-cycle engine (or indeed approaching twice that of a conventional engine in the case of a 180° cycle) with fuel economy and pollution standards comparable to or better than those of four-cycle engines.

It is important to recognise that an attendant advantage of the design is the lower shaft speed which can be attained for equivalent power, as compared with conventional engines. With a piston cycle operating over 180° of cam rotation, the shaft will rotate at half the normal speed, greatly reducing friction losses and their attendant problems. This factor can be magnified in the case of large diameter multicylinder engines, e.g. as applicable in marine engines, where it becomes possible, through the extended cam circumference to obtain a piston cycle within a small fraction of the cam circumference e.g. 90° or less while still maintaining an optimal gradient for motion conversion. In such cases the reduction in rpm can be of immense benefit.

Figure 4:
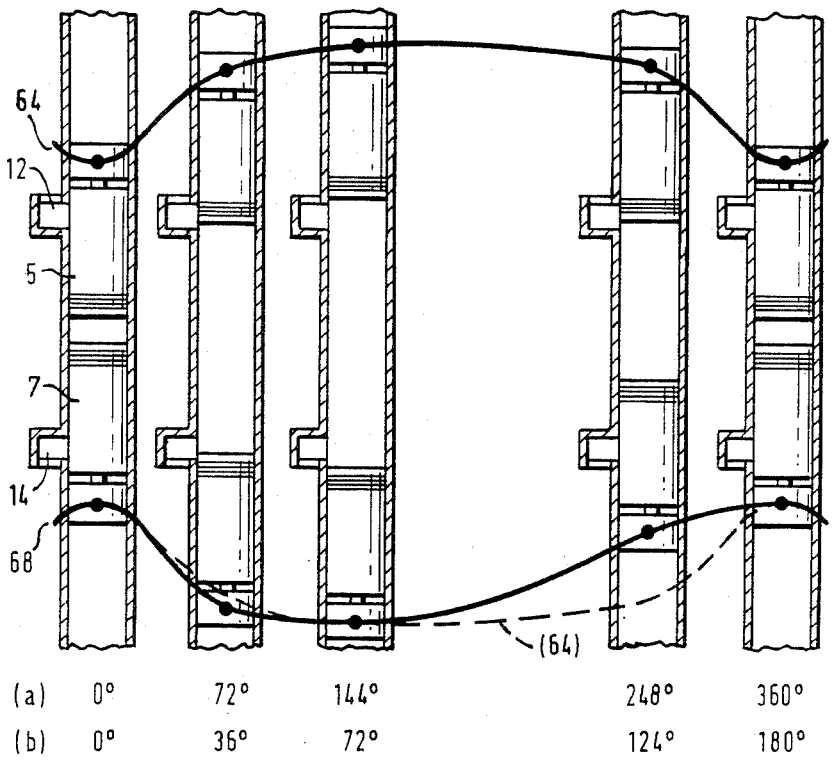
FIG. 4 is a diagram of a second engine cycle which can be attained using the invention.

FIG. 4 shows an alternative set of profiles, and includes further detail of the ports and piston arrangement.

In this cycle an idle phase is included, in which the exhaust and intake ports are kept open together for a considerable portion of the cycle. This idle phase allows the exhaust gases to be completely scavenged by the incoming intake charge, before compression. As before, the piston assembly 7 starts its upward movement towards the next compression stroke ahead of the piston assembly 5 thus pushing a proportion of the charge out through the intake port 12. Cam groove 64 is also shown as a broken line superimposed on cam groove 68, illustrating the different profile. This cycle is illustrated for 360° and 180° of cam element rotation, in FIGS. 4(*a*) and 4(*b*).

In FIGS. 3 and 4, only one pair of piston assemblies 5,7 have been illustrated. In the FIG. 1 embodiment, the second pair of piston assemblies 9,11 would also ride on cam tracks 64,68, but would be 180° of cam element rotation out of phase. Thus, in FIG. 1, in which the cam elements complete one cycle in 360° of cam element rotation, piston assemblies 5,7 are just completing the compression phase, while piston assemblies 9,11 are halfway through the intake/exhaust phases, in which both intake and exhaust ports are open.

Figure 5:
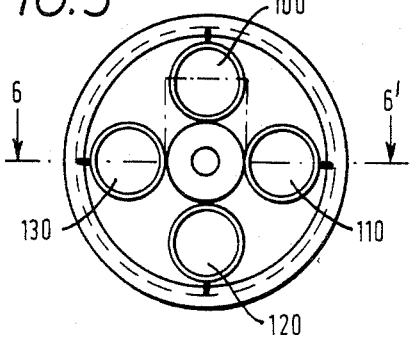
FIG. 5 is a cross-sectional view of a second embodiment of the invention, showing the disposition of cylinders.
Figure 6:
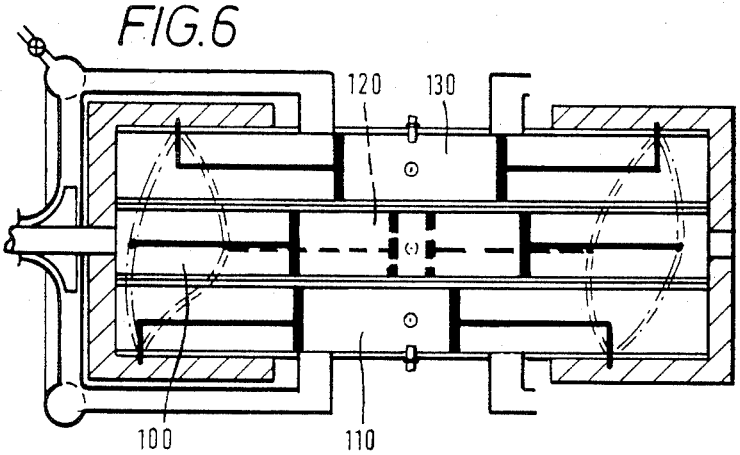
FIG. 6 is a view in longitudinal section taken along the line 6—6' of FIG. 5.

A four cylinder engine of basic construction is shown in FIGS. 5 and 6.

The basic design of engine is similar to that shown in FIG. 1, except that four cylinder bores 100,110,120,130 are provided. Four pairs of opposed pistons then reciprocate in the bores as shown in FIG. 6. The respective piston assemblies are spaced from one another by 90° of cam element rotation. In FIGS. 5 and 6, cam elements which produce an engine cycle within 360° of cam element rotation are shown. As illustrated, the piston assemblies in bore 100 are in the middle of the exhaust-/intake phases (overlap of A and B in FIG. 3); the piston assemblies in bore 110 are just completing the intake phase, before the compression phase; the piston assemblies in bore 120 are just coming up to compression, while the piston assemblies in cylinder 130 have just completed the expansion phase.

Figure 7:
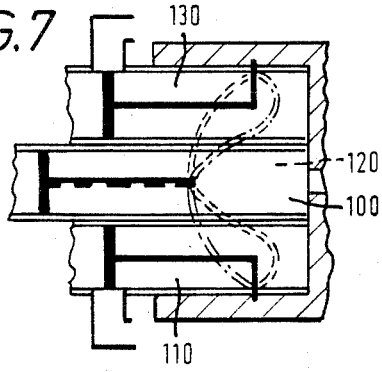
FIG. 7 is a partial longitudinal sectional view of a third embodiment of the invention.

FIG. 7 shows part of a four cylinder engine similar to that shown in FIGS. 5 and 6, in which the engine cycle is completed within 180° of cam element rotation. In this case, cylinder bores 100 and 120 are both coming up to compression, whilst the piston assemblies in cylinder bores 110, 130 are in the middle of the intake/exhaust phase.

It would be possible to arrange six, eight or any desired number of cylinders around the shaft. For a six cylinder arrangement, a complete cycle could be arranged to take place in e.g. 120° of cam rotation, so that in one rotation of the output shaft for the engine as a whole 18 expansion phases would be achieved, or in e.g. 180° of cam rotation so that 12 expansion phases would be achieved.

Figure 8:
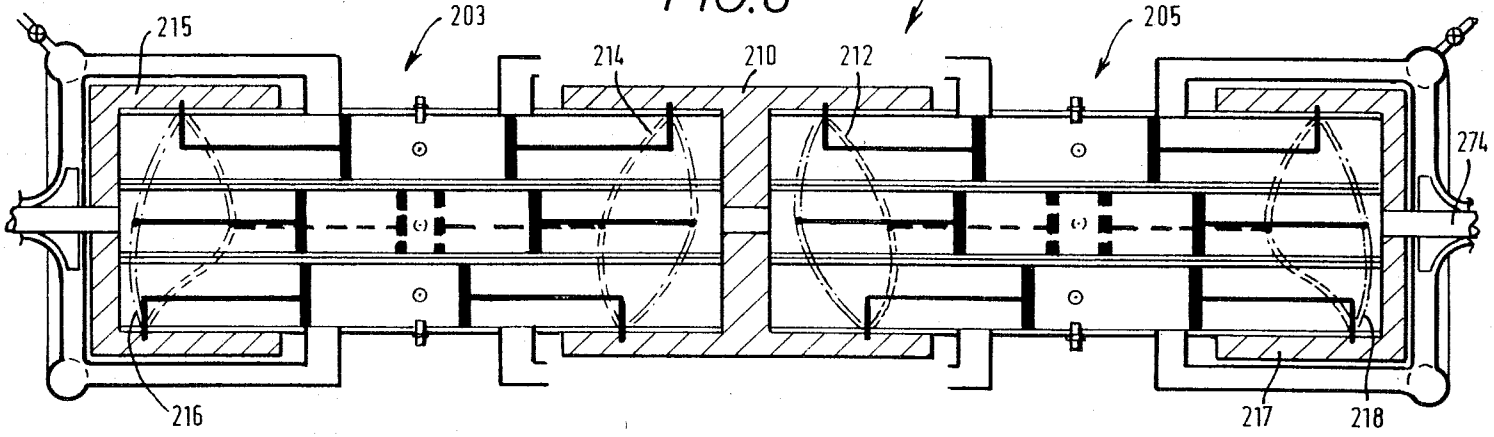
FIG. 8 shows in longitudinal section an engine formed from a combination of engines illustrated in FIGS. 5 and 6.

In FIG. 8 a back-to-back combination of engines is shown.

The engines 201 comprises two component engines 203, 205 which are of the same basic form as those shown in FIG. 5. The engines 203,205 are mounted on a common shaft 274 and have a common cam element 210. Cam element 210 is provided with first and second profiles 212,214. These profiles are exact mirror images of each other, as are the opposed profiles 216, 218 of cam elements 215,217. The movements, of the respective pairs of pistons within the cylinder bores are thus balanced against one another.

Figure 9:
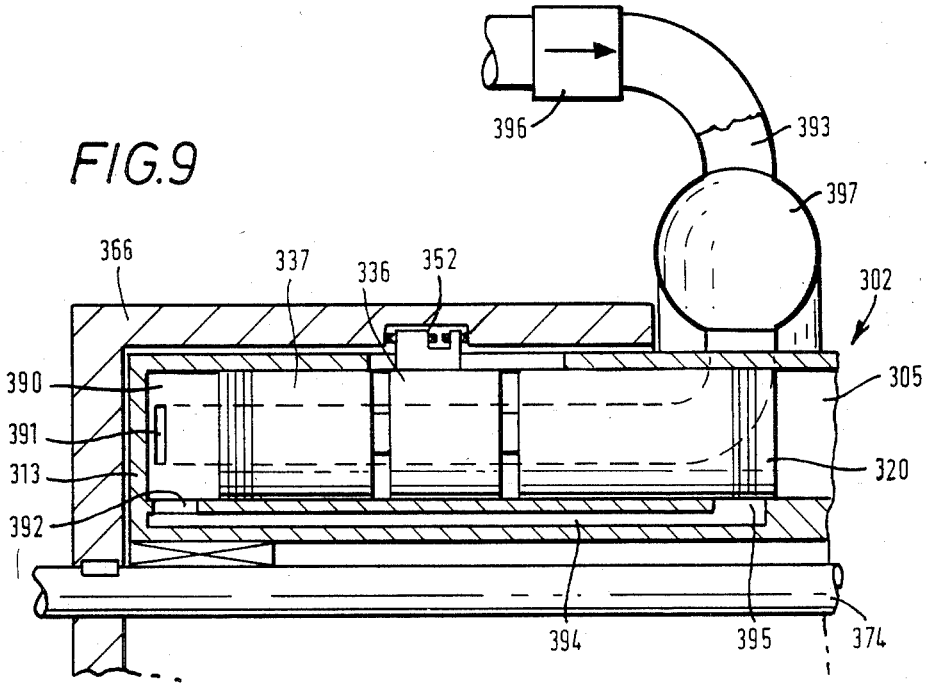
FIG. 9 shows an alternative intake arrangement applicable to the embodiments described.

FIG. 9 shows a modification applicable to the intake system of the described embodiments, in which a scavenge pump arrangement is employed which uses the reciprocation of the intake piston assembly to pressurise the intake charge through a stuffing box arrangement and thus removes the need for a super charger.

Referring to FIG. 9, in which like parts have like reference numerals to those illustrated in FIG. 1 with the addition of 300, piston assembly 305 includes a working piston 320 to which a cylindrical connection portion 336 is attached. The connecting portion 336 holds cam-groove engaging pins 352,352*a* which engage cam element 366. A further piston member 337 is connected to the connecting portion 336. The cylinder bore 305 is closed at end 313 thus providing a charge compression chamber 390. Chamber 390 has two ports 391, 392 disposed in the cylinder walls. Port 391 is connected to a charge intake pipe 393, while port 392 is connected to a charge transfer conduit 394, leading to a transfer port 395. Pipe 393 is provided with a one-way valve 396 and a charge reservoir 397. In use, upward movement of the piston 337 during the compression phase causes charge to be drawn into the charge reservoir 397 and chamber 390, through pipe 393 via one-way valve 396. When the combusted gases are then expanded, downward movement of the piston assembly 305 forces the charge up through transfer conduit 395 and into cylinder 302. When the opposed piston, within cylinder 302, reduces the intake volume, charge is pushed back through the transfer port 395, to the charge reservoir 397. The compression phase then proceeds as before.

Figure 10:
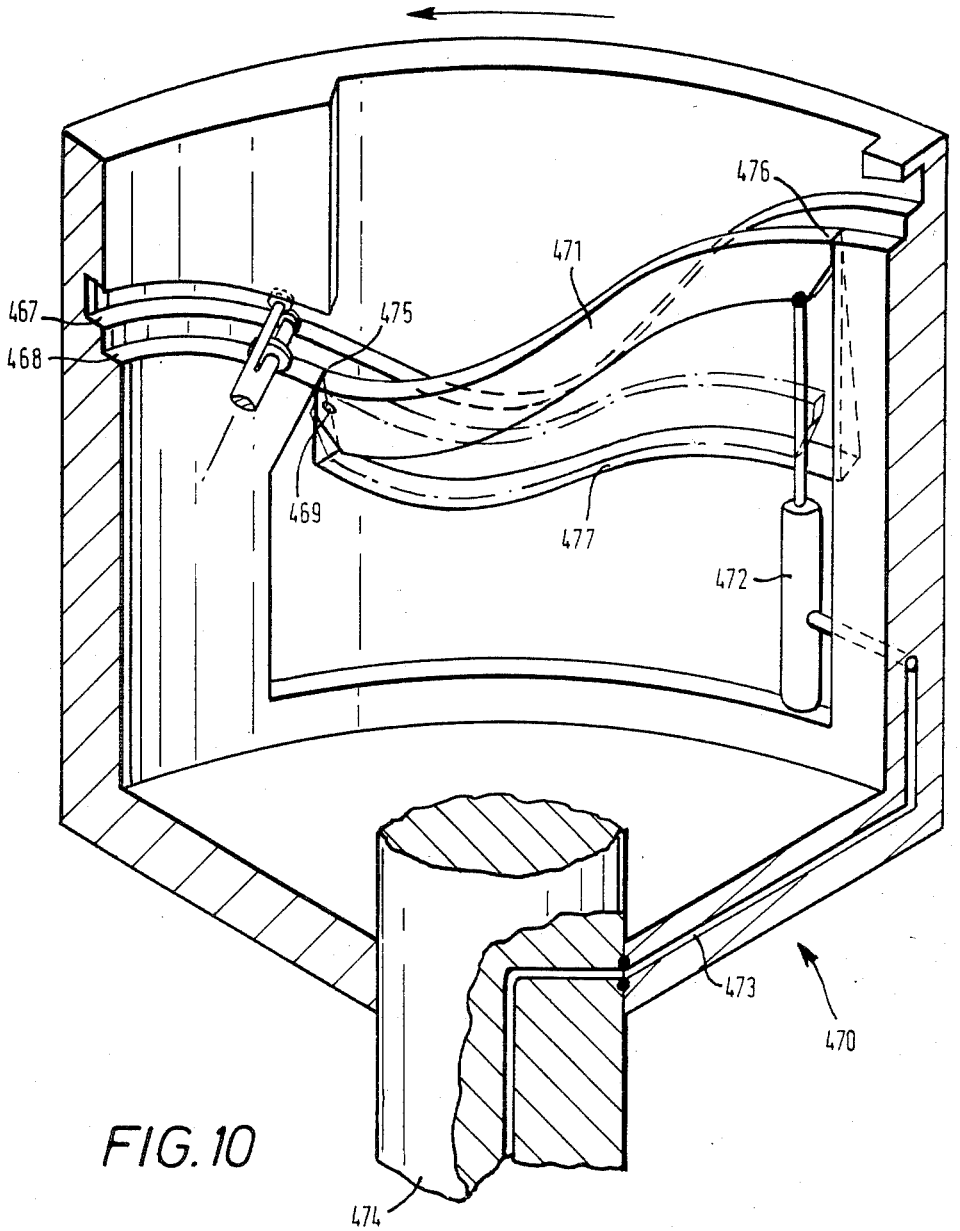
FIG. 10 shows a cam element modification applicable to the described embodiments.
Figure 11:
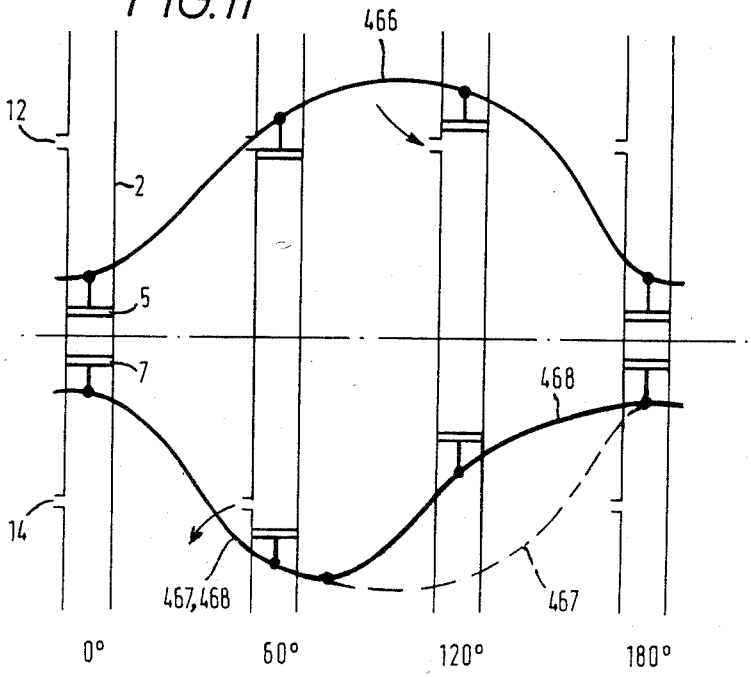
FIG. 11 shows a cam profile which can be attained using the modification shown in FIG. 10.

A further modification, applicable to the exhaust port engaging cam element, is shown in FIGS. 10 and 11, which illustrates the modification in an engine which completes its engine cycle in 180° of cam element rotation.

A section of a cam element 470 is shown, having two relatively stepped cam contours 467, 468. The contours 467,468 are identical for most of their profile, contour 467 taking the form of a groove, and contour 468 being formed as a ledge.

The cam contours 467,468 differ in profile over the section as illustrated. Cam contour 467 follows a path which is substantially similar to the opposed cam element 466, as shown diagrammatically in FIG. 11. Cam contour 468, on the other hand, has a pivotable portion 471, the profile of which, when in its operating position, causes the exhaust port engaging piston assembly (not shown) to advance more quickly towards the centre position of the cylinder, as shown in FIG. 11. The contour 467 thus constrains the exhaust piston assembly to move symmetrically with respect to the intake piston assembly, while the contour 468 constrains the exhaust piston assembly to follow a profile similar to that shown in FIG. 3, in which the intake volume of the cylinder is reduced, relative to the expansion volume.

The portion 471 of the cam contour 468 is pivoted, relative to the remainder of the contour 468 at point 469. Rotation of the portion 471 around the pivot point 469 is controlled by a hydraulic ram 472, fed from an externally controlled fluid supply (not shown) through channels 473 and shaft 474.

The piston assembly bearing arrangement is modified to have three bearing races 473,473*a*,474, attached to pin 454. Bearing 474 is made larger than bearing 473 in order to accomodate the step between the two cam contours 467,468. Bearing 473*a* acts as a follower, guiding the piston assembly against the inner ledge of cam contour 467.

In use, one of the two contours is chosen. If contour 467 is chosen, hydraulic ram 472 is depressed, so that portion 471 is positioned below the running level of the bearings 473, 474. The bearings 473,474, pin 454 and the piston assembly to which they are connected, follow both cam contours 467,468 for most of the cam track. However the pin 454 will follow cam profile 467 alone over the section at which the pivoted portion 471 is depressed, riding on bearing 473, until the two cam contours resume the same profile at point 476. In this mode, therefore, the exhaust engaging piston will move in symmetry with the intake engaging piston and will not reduce the intake volume of the cylinder with respect to the expansion volume.

If contour 468 is chosen, the hydraulic ram 472 is engaged to raise the portion 471 so that it forms a continuous track through points 475 and 476. The piston assembly will then follow cam contour 468, and will ride over the section between points 475 and 476 on bearing 471 only, cam contour 467 now being below the level of cam contour 468. In this mode, the exhaust engaging piston will move to reduce the intake volume of the cylinder, relative to the exhaust volume, in the manner illustrated in FIG. 10.

This arrangement thus allows the action of the exhaust piston assemblies to be adjusted according to requirements. If the engine is embodied in a motor vehicle, the hydraulic ram 472 is preferably controlled directly by the driver, suitable engine-disengaging clutch means being employed to allow the cam profiles to be changed during motion of the vehicle if desired.

Furthermore, the cam contours over the section 475 to 476 can be formed to allow a continuous variation in the intake volume which can be effected by adjusting the position of portion 471 so that it raises the exhaust piston assembly to a greater or lesser degree. For minimium wear, the cam elements should have smooth lead in and lead out points, at which the respective cam contours start and finish taking the load of the piston assembly.

As will be seen, the cam contours over the section between points 475 to 476 take the form of a ledge for both contours. As the motion of the piston assemblies is always against the outer surface of the cam profiles over section 475 to 476, a contrafacing surface, which would form a slot, is not required.

In order to accommodate the pivotable portion 471 in its depressed position, the side of the cam element 470 needs to be machined to form an internal slot/ledge 477, of steadily increasing cross section, as shown, in directions downwardly and away from the pivot point.

Figure 12:
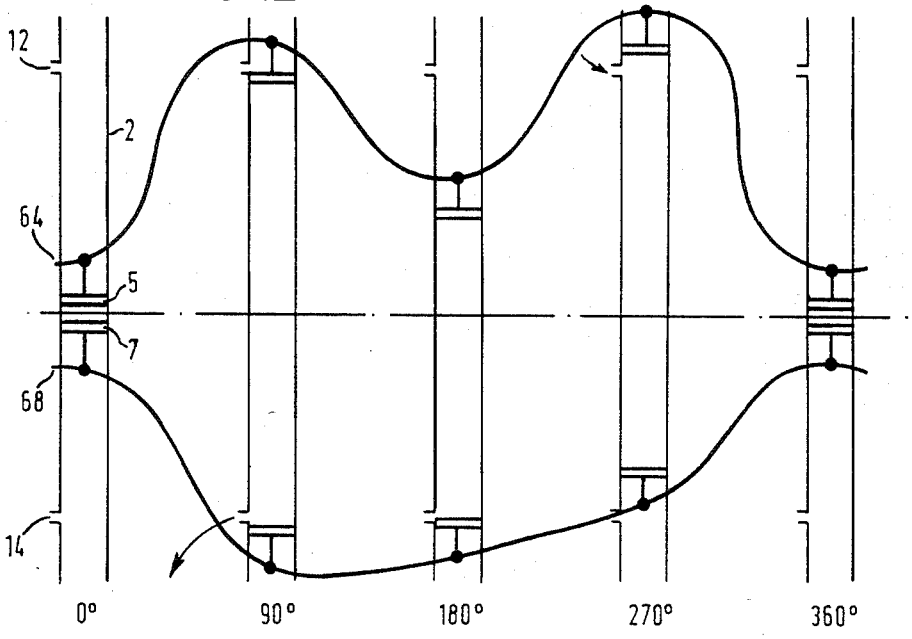
FIG. 12 shows a third engine cycle which can be attained using the invention.

FIG. 12 illustrates a different cycle which can be attained using the invention, which approaches four cycle operation.

Starting with ignition at 0°, the piston assemblies complete an expansion phase as shown, to the position e.g. at 90° in which the exhaust port 14 is uncovered while the inlet port 12 is not.

The piston assembly 5 moves inwardly from the bottom of the expansion stroke to aid the scavenging of exhaust gases to the position as shown at e.g. 180°. At this point the exhaust port 14 is closed by upward of piston assembly 7. The piston assembly 7 then continues its upward movement to the next compression stroke. Simultaneously, the piston assembly 5 moves away from its inward position in the cylinder 2 to uncover inlet port 12. Relative movement of piston assemblies 5,7 can be adjusted so that a vaccuum is left in the cylinder 2 to aid intake of new charge through port 12. The piston assembly 7 also moves sufficiently to maintain the reduced volume into which the intake gases are to be directed. The intake port 12 is closed by upward movement of the piston assembly 5 towards the compression stroke at e.g. 360°/0°.

Although the invention has been shown with cam means comprising a pair of grooved cam elements, the invention is not limited to this design and spring biased cam shafts could be used, for example.

Furthermore, the precise cylinder arrangement shown is not essential. For example, two cylinders having a fluid interconnection and a common combustion chamber could be used.

It should also be apparent that the cam profiles as shown in FIGS. 3,4, 10 and 11 are only illustrative and any pair of cam profiles could be chosen which reduce the effective intake volume of the cylinder, with respect to the expansion volume.

Also, the shaft 74 may include adjustment means to allow the cam elements 66,70, some degree of longitudinal adjustment, to alter the compression ratio in cylinders 2,3 and/or some degree of rotational adjustment, to allow adjustment of the timing of the engine, if desired, when the engine is running.

It will also be apparent to those skilled in the art that the rotating masses of the engine should be balanced taking into account the fluctuation of the forces developed. Also, the engines may be combined not only as shown in FIG. 8, but also like engines could quite easily be connected in parallel, in a balanced arrangement, by means of, for example, a gearbox.

I claim:

1. In an internal combustion engine operable using a cycle having expansion, exhaust, intake and compression phases, which engine comprises at least one pair of opposed pistons which reciprocate in cylinder portions which are in fluid communication with each other via a common combustion chamber, the pistons being coupled to respective cam elements engaged with a common output shaft for converting the reciprocating motion of the pistons into rotational motion, and the cylinder portions having intake and exhaust ports in the cylinder walls arranged such that each intake port is engaged by one piston and each exhaust port is engaged by the respective opposed piston; the improvement comprising that the cam elements are provided with different cam profiles profiled at least along those cam portions proceeding the closing of the intake port to cause the respective pistons to uncover the respective exhaust and inlet ports in a timed sequence such that an exhaust stroke length formed between the opposed pistons when the exhaust port is initially opened, is longer than an intake stroke length formed between the opposed pistons when the inlet port is closed, at which time the exhaust port engaging piston has moved from the exhaust port by an amount of at least 10% of a distance from the exhaust port to the center of the common combustion chamber at ignition to produce a sufficient increase in effective volume of the expansion phase with respect to the intake phase to give hyper-expansion.

2. A multiple engine which comprises a least two component engines as claimed in claim 1, a pair of such component engines being positioned in one out of a group of in line, back to back and side by side.

3. An engine as claimed in claim 1 or 2 wherein the exhaust and intake phases overlap to form an idle phase in which both exhaust and intake ports are open.

4. An engine as claimed in claim 1 or 2 wherein a single cylinder forms each respective pair of cylinder portions.

5. A hyper-expansion internal combustion engine, operable using a cycle having expansion, exhaust, intake and compression phases, which engine comprises at least one pair of opposed pistons which reciprocate in connecting cylinder portions having a common combustion chamber, the pistons being coupled to respective cam elements engaged with a common output shaft for converting the reciprocating motion of the pistons into rotational motion, the connecting cylinder portions having an intake and an exhaust port, each port being engaged by a respective opposed piston which controls flow through the port; the cam elements being provided with cam profiles which are asymmetric to an extent greater than that required for full exhaust and intake port opening and closing such that a ratio of expansion volume when the exhaust port opens to compression volume when the intake port closes is at a value not less than 1.14:1.

6. An engine as claimed in claim 5 wherein the cam profiles are asymmetric over a cam arc including the whole of the intake phase and at least part of the compression phase.

7. An engine as claimed in claim 5 wherein the cam profiles are asymmetric over a cam arc including substantially the whole of the intake and compression phases.

8. An engine as claimed in claim 5 wherein the cam profiles are asymmetric over a cam arc inclusive of bottom dead centre positions and extending to the full compression position.

9. An engine as claimed in claim 5, 6, 7 or 8 wherein the cycle has an idle phase in which both exhaust and intake ports are open.

10. An engine as claimed in claim 1 or 5 wherein the cycle is completed during a single reciprocation of each respective piston.

11. An engine as claimed in claim 1 or 5 wherein the cycle is completed in 180 degrees of cam element rotation.

12. An engine as claimed in claim 1 or 5 wherein the cycle is completed in 120° of cam element rotation.

13. An engine as claimed in claim 1 or 5 wherein the cycle is completed in 90° or less of cam element rotation.

14. An engine as claimed in claim 1 or 5 wherein, at closure of the intake port by the intake piston, the opposed piston is spaced from the corresponding exhaust port towards the center of the common combustion chamber by at least 10% of the distance between the exhaust port closure position of the exhaust piston and the center of the common combustion chamber.

15. An engine as claimed in claim 14 wherein the opposed piston is spaced by not more than essentially 100% of said distance.

16. An engine as claimed in claim 1 or 5 wherein the cam profile engaged by the exhaust port engaging piston is adjustable by movement of a portion of the cam element relative to the remainder of that cam element enabling an adjustable degree of asymmetricity with respect to the cam profile engaged by the intake position and thereby an adjustable degree of hyper-expansion during running of the engine.

17. An engine as claimed in claim 16 wherein said cam element portion is pivotable attached to said remainder of the cam element.

18. An engine as claimed in claim 16 wherein in one position of the adjustable cam profile the reciprocal movements of the respective pistons are substantially identical, and in another position, the respective pistons uncover the respective exhaust and inlet ports so as to produce a sufficient increase in the effective volume of the expansion phase with respect to the intake phase to give hyper-expansion.

19. An engine as claimed in claim 1 or 5 wherein at least one of the cam elements has an adjustable cam profile.

20. An engine as claimed in claim 19 wherein said adjustable cam profile is adjustable during movement of the engine.

21. An engine as claimed in claim 19 wherein the cam profile is adjustable by movement of a portion of the cam element relative to the remainder of the cam element.

22. An engine as claimed in claim 21 wherein said cam element portion is pivotably attached to said remainder of the cam element.

23. An engine as claimed in claim 21 wherein the cam element has first and second profiles, the second profile including said cam element portion.

24. An engine as claimed in claim 23 wherein the first and second cam profiles are different only at said cam element portion.

25. An engine as claimed in claim 1 or 5 wherein the combustion chamber is provided with fuel injection means and is supplied with pressurized air through the respective intake ports.

26. An engine as claimed in claim 25 wherein said pressurized air is provided by a positive displacement pump.

27. An engine as claimed in claim 25 wherein the pressure of said pressurized air is adjusted in accordance with setting of a throttle means.

28. An engine as claimed in claim 25 wherein said pressurized air is provided by respective stuffing boxes engaged with respective intake pistons.

29. An engine as claimed in claim 25 wherein said pressurised air is provided by a supercharger.

30. An engine as claimed in claim 29 wherein a pressurized air reservoir is provided between the supercharger and said intake ports.

* * * * *